US008042601B2

(12) United States Patent
Bowman et al.

(10) Patent No.: US 8,042,601 B2
(45) **Date of Patent: *Oct. 25, 2011**

(54) SIDE DAM WITH INSERT

(75) Inventors: Brian E. Bowman, Waveland, IN (US); Michael A. Schueren, Crawfordsville, IN (US); Walter N. Blejde, Brownsburg, IN (US)

(73) Assignee: Nucor Corporation, Charlotte, NC (US)

( * ) Notice: Subject to any disclaimer, the term of this patent is extended or adjusted under 35 U.S.C. 154(b) by 196 days.

This patent is subject to a terminal disclaimer.

(21) Appl. No.: 12/490,720

(22) Filed: Jun. 24, 2009

(65) Prior Publication Data

US 2009/0283240 A1 Nov. 19, 2009

Related U.S. Application Data

(63) Continuation-in-part of application No. 11/277,414, filed on Mar. 24, 2006, now Pat. No. 7,556,084.

(51) Int. Cl.
*B22D 11/06* (2006.01)

(52) U.S. Cl. ..... 164/428

(58) Field of Classification Search ..... 164/480, 164/428

See application file for complete search history.

(56) References Cited

U.S. PATENT DOCUMENTS

| | | | | |
|---|---|---|---|---|
| 4,723,590 | A | 2/1988 | Yamauchi et al. | |
| 5,060,714 | A | 10/1991 | Yamauchi et al. | |
| 5,154,222 | A * | 10/1992 | Salaris et al. | 164/428 |
| 5,184,668 | A | 2/1993 | Fukase et al. | |
| 5,277,243 | A | 1/1994 | Fukase et al. | |
| 5,318,097 | A * | 6/1994 | Blin et al. | 164/428 |
| 5,762,126 | A | 6/1998 | Assefpour-Desfully et al. | |
| 5,810,070 | A | 9/1998 | Osada et al. | |
| 5,871,039 | A | 2/1999 | Osada et al. | |
| 5,915,454 | A | 6/1999 | Wright et al. | |
| 5,924,476 | A | 7/1999 | Spink | |
| 5,960,855 | A | 10/1999 | Assefpour-Desfully et al. | |
| 6,032,722 | A * | 3/2000 | Russell et al. | 164/428 |
| 6,082,437 | A | 7/2000 | Damasse et al. | |

(Continued)

FOREIGN PATENT DOCUMENTS

| | | |
|---|---|---|
| EP | 0355940 | 2/1990 |
| JP | 60-162558 | 8/1985 |
| JP | 62-064456 | 3/1987 |

(Continued)

OTHER PUBLICATIONS

Notification of co-pending applications, dated Feb. 10, 2010.

*Primary Examiner* — Kevin P Kerns
(74) *Attorney, Agent, or Firm* — Hahn, Loeser & Parks LLP; Arland T. Stein

(57) ABSTRACT

A side dam for use in a continuous twin roll caster system includes a body of refractory material having opposed outer surfaces with one outer surface adapted to contact molten metal and casting rolls in a continuous twin roll caster system and retain molten metal, and an opposite outer surface having fastening portions of refractory material adapted to attach the side dam to a side dam holder to hold the side dam in place during casting; an aperture in the outer surface of the body positioned adjacent a nip of the continuous twin roll caster system and adapted to receive a side dam insert; and a side dam insert of a second refractory material harder than the refractory material of the body having a first surface adapted to contact molten metal and form with the outer surface of the body the outer surface of the side dam.

48 Claims, 13 Drawing Sheets

U.S. PATENT DOCUMENTS

| | | | | |
|---|---|---|---|---|
| 6,257,315 | B1 | 7/2001 | Spink | |
| 6,378,598 | B1 | 4/2002 | Tonelli et al. | |
| 7,258,157 | B2 | 8/2007 | Damasse et al. | |
| 7,503,375 | B2 * | 3/2009 | Schueren | 164/428 |
| 7,556,084 | B2 * | 7/2009 | Bowman et al. | 164/428 |
| 7,938,167 | B2 | 5/2011 | D'Hone et al. | |
| 2007/0267168 | A1 | 11/2007 | Schueren | |

FOREIGN PATENT DOCUMENTS

| | | |
|---|---|---|
| JP | 02-099244 | 4/1990 |
| JP | 07-068352 | 3/1995 |
| JP | 08-13403 | 2/1996 |
| JP | 11-347692 | 12/1999 |
| JP | 2000-000641 | 1/2000 |
| WO | 99/32247 | 7/1999 |

* cited by examiner

SIDE DAM WITH INSERT

RELATED APPLICATIONS

This application is a continuation-in-part of U.S. patent application Ser. No. 11/277,414, filed Mar. 24, 2006, now U.S. Pat. No. 7,556,084, the disclosure of which is incorporated herein by reference.

BACKGROUND AND SUMMARY

In the continuous casting method of manufacturing steel, molten (liquid) steel is cast directly into thin strip by a casting machine. The shape of the strip is determined by the mold of the casting machine, which receives the molten metal from a tundish and casts the metal into thin strip. The strip may be further subjected to cooling and processing upon exit from the casting rolls.

In a twin roll caster, molten metal is introduced between a pair of counter-rotated horizontal casting rolls which are internally cooled so that metal shells solidify on the moving casting roll surfaces, and are brought together at the nip between the casting rolls to produce a thin cast strip product, delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

When casting steel strip in a twin roll caster, the thin cast strip leaves the nip at very high temperatures, of the order of 1400° C. If exposed to normal atmosphere, it will suffer very rapid scaling due to oxidation at such high temperatures. A sealed enclosure that contains an atmosphere that inhibits oxidation of the strip is therefore provided beneath the casting rolls to receive the thin cast strip, and through which the strip passes away from the strip caster. The oxidation inhibiting atmosphere may be created by injecting a non-oxidizing gas, for example, an inert gas such as argon or nitrogen, or combustion exhaust reducing gases. Alternatively, the enclosure may be substantially sealed against ingress of an ambient oxygen-containing atmosphere during operation of the strip caster, and the oxygen content of the atmosphere within the enclosure reduced during an initial phase of casting, by allowing oxidation of the strip to extract oxygen from the sealed enclosure as disclosed in U.S. Pat. Nos. 5,762,126 and 5,960,855.

The length of a casting campaign of a twin roll caster has been generally determined in the past by the wear cycle on the core nozzle, tundish and side dams. Multi-ladle sequences can be continued so long as the source of hot metal supplies ladles of molten steel, by use of a turret on which multiple ladles of molten metal can be transferred to operating position. Therefore, the focus of attention in the casting has been extending the life cycle of the core nozzle, tundish and side dams, and thereby reducing the cost per ton of casting thin strip. When a nozzle, tundish or side dam would wear to the point that one of them had to be replaced, the casting campaign would have to be stopped, and the worn out component replaced. This would generally require removing other unworn components as well since otherwise the length of the next campaign would be limited by the remaining useful life of the worn but not replaced refractory components, with attendant waste of useful life of refractories and increased cost of casting steel. Further, all of the refractory components, both replaced and continued components, would have to be preheated the same as starting the original casting campaign before the next casting could be done. Graphitized alumina, boron nitride and boron nitride-zirconia composites are examples of suitable refractory materials for the side dams, tundish and core nozzle components. Also, since the core nozzle, tundish and side dams all have to be preheated to very high temperatures approaching that of the molten steel to withstand contact with the molten steel over long periods, considerable waste of casting time between campaigns resulted. See U.S. Pat. Nos. 5,184,668 and 5,277,243.

Also, the side dams wear independently of the core nozzles and tundish, and independently of each other. The side dams must initially be urged against the ends of the casting rolls under applied forces, and "bedded in" by wear so as to ensure adequate seating against outflow of molten steel from the casting pool. The forces applied to the side dams may be reduced after an initial bedding-in period, but will always be such that there is significant wear of the side dams throughout the casting operation. For this reason, the core nozzle and tundish components in the metal delivery system could have a longer life than the side dams, and could normally continue to be operated through several more ladles of molten steel supplied in a campaign if the useful life of the side dams could be extended. The tundish and core nozzle components, which still have useful life, are often changed when the side dams are changed to increase casting capacity of the caster. Further, the core nozzle must be put in place before the tundish, and conversely the tundish must be removed before core nozzle can be replaced, and both of these refractory components wear independently of each other.

In addition, no matter which refractory component wears out first, a casting run will need to be terminated to replace the worn out component. Since the cost of thin cast strip production is directly related to the length of the casting time, unworn components in the metal delivery system are generally replaced before the end of their useful life as a precaution to avoid further disruption of the next casting campaign. This results in attendant waste of useful life of refractory components.

Each side dam is generally held in place during casting by a side dam holder. The side dam typically includes a V-shaped beveled bottom portion and the side dam holder typically includes a V-shaped receptacle into which the V-shaped beveled bottom portion of the side dam is seated. The V-shape configuration serves to position and hold the side dam in place during casting. However, such side dam assemblies limit the useful life of the side dams before adversely impacting the edges of the cast strip and risking serious damage to the casting equipment. Specifically, the worn side dams and side dam holders may allow bleeding molten metal if the side dams are allowed to wear past a certain point, and result in damage to the casting equipment. Therefore, the side dams are usually replaced before such damage to the edges of the cast strip and to the casting equipment can occur limiting the duration of the casting campaign. As explained above, when the side dams are changed, the removable tundish and nozzle core will generally also be changed and a new casting campaign started. The casting costs per ton of thin strip cast thus could be considerably reduced if the useful life of the side dams could be extended.

It has been further observed that greater pressure is exerted between the side dam and casting rolls adjacent the nip and has resulted in increased localized wear of the side dam adjacent the nip. This additional wear adjacent the nip had led to a groove or channel forming in the side dam in that area. Further, the increased wear in this location reduces the useful life of the overall side dam, which further reduces productivity of a continuous caster system because of the need to change side dams more often.

Further limitations and disadvantages of previously used and proposed thin strip casting systems and methods will become apparent to one of skill in the art, through comparison of such systems and methods with the disclosure as set forth in this present application.

Presently disclosed is a side dam for use in a continuous twin roll caster system comprising: a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting; an aperture in the outer surface of the body positioned adjacent a nip of the continuous twin roll caster system and adapted to receive a side dam insert; and a side dam insert of a second refractory material harder than the refractory material of the body having a first surface adapted to contact molten metal and form with the outer surface of the body the outer surface of the side dam.

Also disclosed is the fastening portions of the refractory material of the body extending outward from the opposite outer surface adapted to attach said side dam to a side dam holder to hold said side dam in place during casting. Additionally, the aperture of the side dams may further comprise a notch and the side dam insert may further comprise a protrusion adapted to engage the notch of the aperture and secure the side dam insert to the side dam. The aperture and the side dam insert may have tapered sides adapted to retain the side dam insert during operation of the side dam in a continuous twin roll caster system.

The side dam insert may extend no more than 35 mm above the nip of the continuous twin roll caster system, or may be 30 mm in length where the casting rolls are of a diameter less than 0.6 meter. Alternatively, the side dam insert may extend no more than 75 mm above the nip of the continuous twin roll caster system, or may be 60 mm in length where the casting rolls are of a diameter between 0.8 and 1.2 meters, or more. The width of the side dam insert may be substantially the same as the width of the nip of the continuous twin roll caster system. Alternatively, the width of the side dam insert may be between 1.5 mm and 25 mm, or between 5 mm and 10 mm. In another alternative, the side dam insert extends the full width of the side dam adjacent the nip of the continuous twin roll caster system.

The side dam insert may be at least 1 mm thick, may extend substantially from the outer surface adapted to contact molten metal to the opposite outer surface having fastening portions of refractory material, or may have substantially the same thickness as the body of refractory material.

The first surface of the side dam insert may form between 5% and 70% or between 10% and 60% of the outer surface of the side dam located within 35 mm or located within 75 mm of the nip of the continuous twin roll caster system. In some embodiments, the first surface of the side dam insert may form between 5% and 70% or between 10% and 60% of the outer surface of the side dam located within 35 mm when the diameters of the casting rolls are less than 0.6 meter. In other embodiments, the first surface of the side dam insert may form between 5% and 70% or between 10% and 60% of the outer surface of the side dam located within 75 mm when the diameters of the casting rolls are within 0.8 and 1.2 meters, or larger.

The second refractory material of the side dam insert may have a hardness greater than 100 HB, greater than 150 HB, between 200 HB and 600 HB, or between 250 HB and 450 HB, where HB represents a Brinell hardness number as defined in the Ninth Edition of *Mark's Standard Handbook for Mechanical Engineers* on page 5-13 and exemplified on pages 5-3 and 6-22. Additionally, the second refractory material may be at least two times or at least three times harder than the body of refractory material. Further, the side dam insert of a second refractory material may comprise boron nitride (BN) or zirconium oxide ($ZrO_2$) or both. Additionally, the side dam insert of a second refractory material may also comprise any one of or any combination of boron nitride (BN), zirconium oxide ($ZrO_2$) and silicon carbide (SiC).

Also disclosed is a continuous twin roll caster system comprising:

(a) a pair of counter-rotatable casting rolls to form a nip there between through which thin strip can be cast, and a pair of confining side dams adjacent the ends of the casting roll capable of supporting a casting pool of molten metal formed on the casting surfaces above the nip, (b) each side dam comprising:

(i) a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting;

(ii) an aperture in the outer surface of the body positioned adjacent a nip of the continuous twin roll caster system and adapted to receive a side dam insert; and (iii) a side dam insert of a second refractory material harder than the refractory material of the body having a first surface adapted to contact molten metal and form with the outer surface of the body the outer surface of the side dam, (c) an elongated metal delivery system capable of discharging molten metal to form the casting pool supported on the casting surfaces of the casting rolls confined by the side dams.

DETAILED DESCRIPTION OF THE DRAWINGS

Figure 1A:
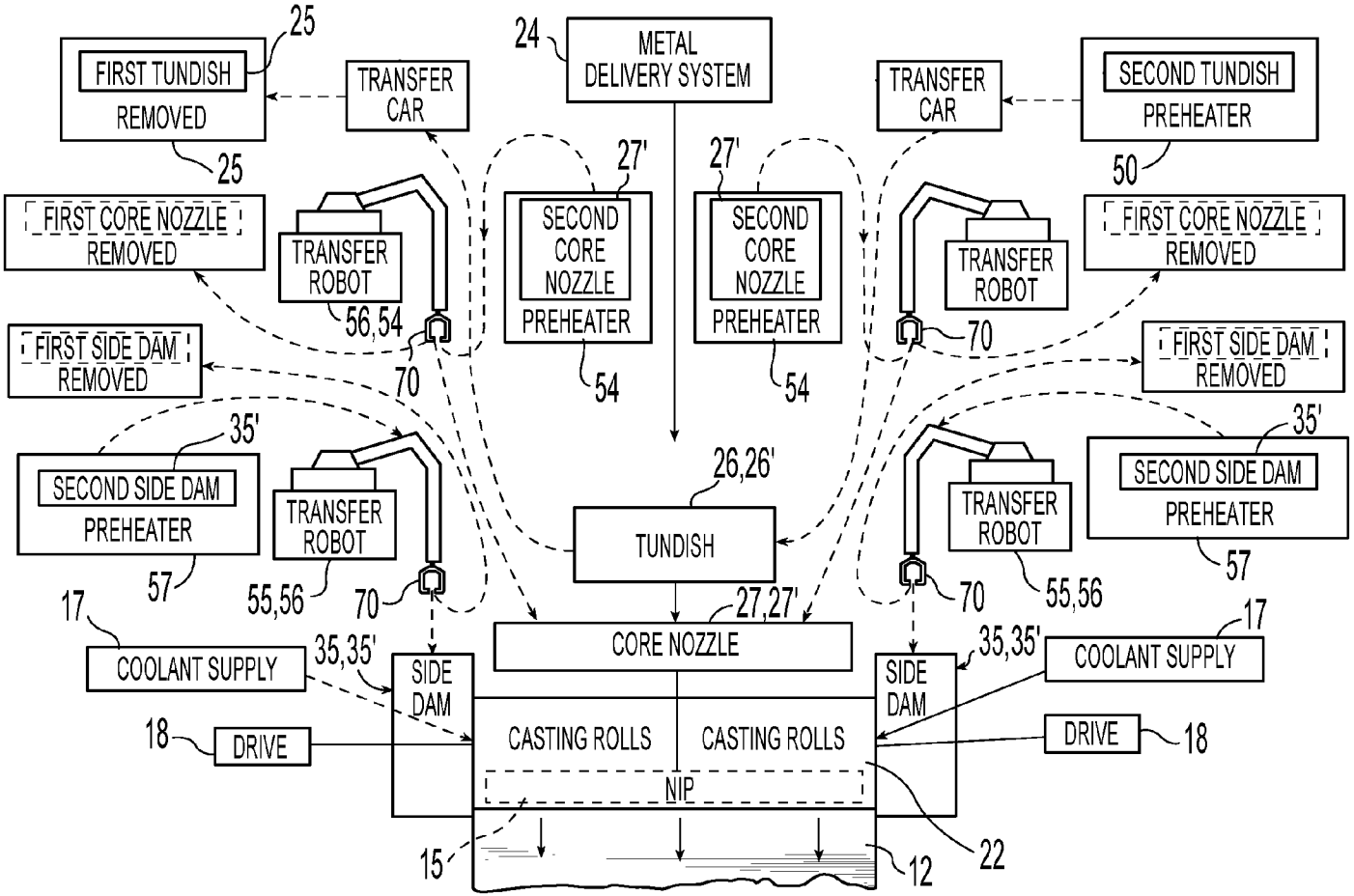
FIGS. 1A-1G illustrate various aspects of an exemplary continuous twin roll caster system in which several embodiments may be used.

FIGS. 1A-1G illustrate various aspects of an exemplary continuous twin roll caster system in which several embodiments may be used.

The illustrative twin roll caster comprises a twin roll caster denoted generally as 11 producing a thin cast strip 12 which passes within a sealed enclosure 10 to a guide table 13, which guides the strip to a pinch roll stand 14 through which it exits the sealed enclosure 10. The seal of the enclosure 10 may not be complete, but appropriate to allow control of the atmosphere within the enclosure and access of oxygen to the cast strip within the enclosure as hereinafter described. After exiting the sealed enclosure 10, the strip may pass through other sealed enclosures and may be subjected to in-line hot rolling and cooling treatment.

Twin roll caster 11 comprises a pair of laterally positioned casting rolls 22 forming a nip 15 therebetween, to which molten metal from a ladle 23 is delivered through a metal delivery system 24. Metal delivery system 24 comprises a tundish 25, a removable tundish 26 and one or more core nozzles 27 which are located above the nip 15. The molten metal delivered to the casting rolls is supported in a casting pool 16 on the casting surfaces of the casting rolls 22 above the nip 15.

The casting pool of molten steel supported on the casting rolls is confined at the ends of the casting rolls 22 by a pair of first side dams 35, which are applied to stepped ends of the rolls by operation of a pair of hydraulic cylinder units 36 acting through thrust rods 50 connected to side dam holders 37.

The casting rolls 22 are internally water cooled by coolant supply 17 and driven in counter rotational direction by drives 18, so that metal shells solidify on the moving casting roll surfaces as the casting surfaces move through the casting pool 16. These metal shells are brought together at the nip 15 to produce the thin cast strip 12, which is delivered downwardly from the nip 15 between the rolls.

Figure 1B:
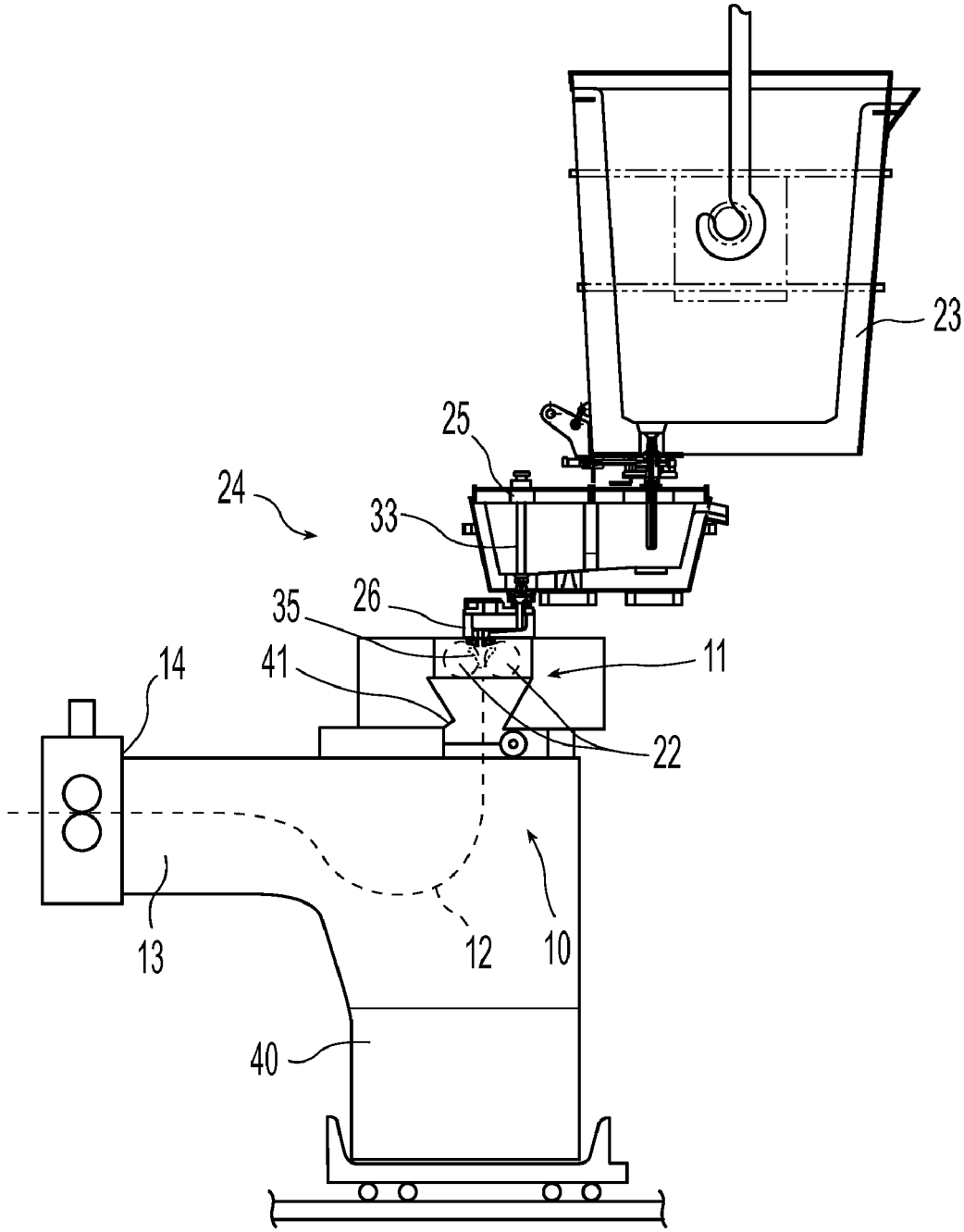
Figure 1C:
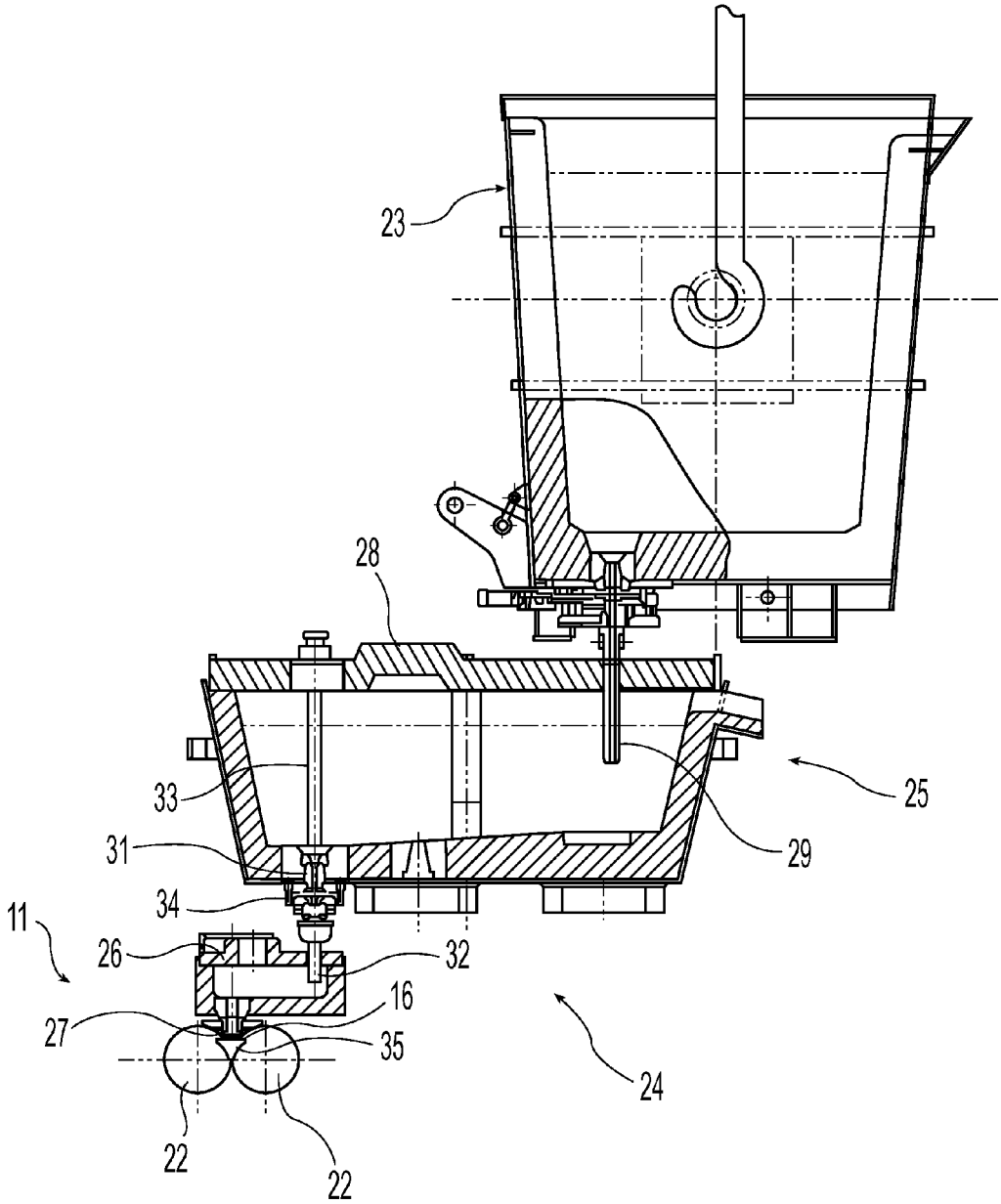
Figure 1D:
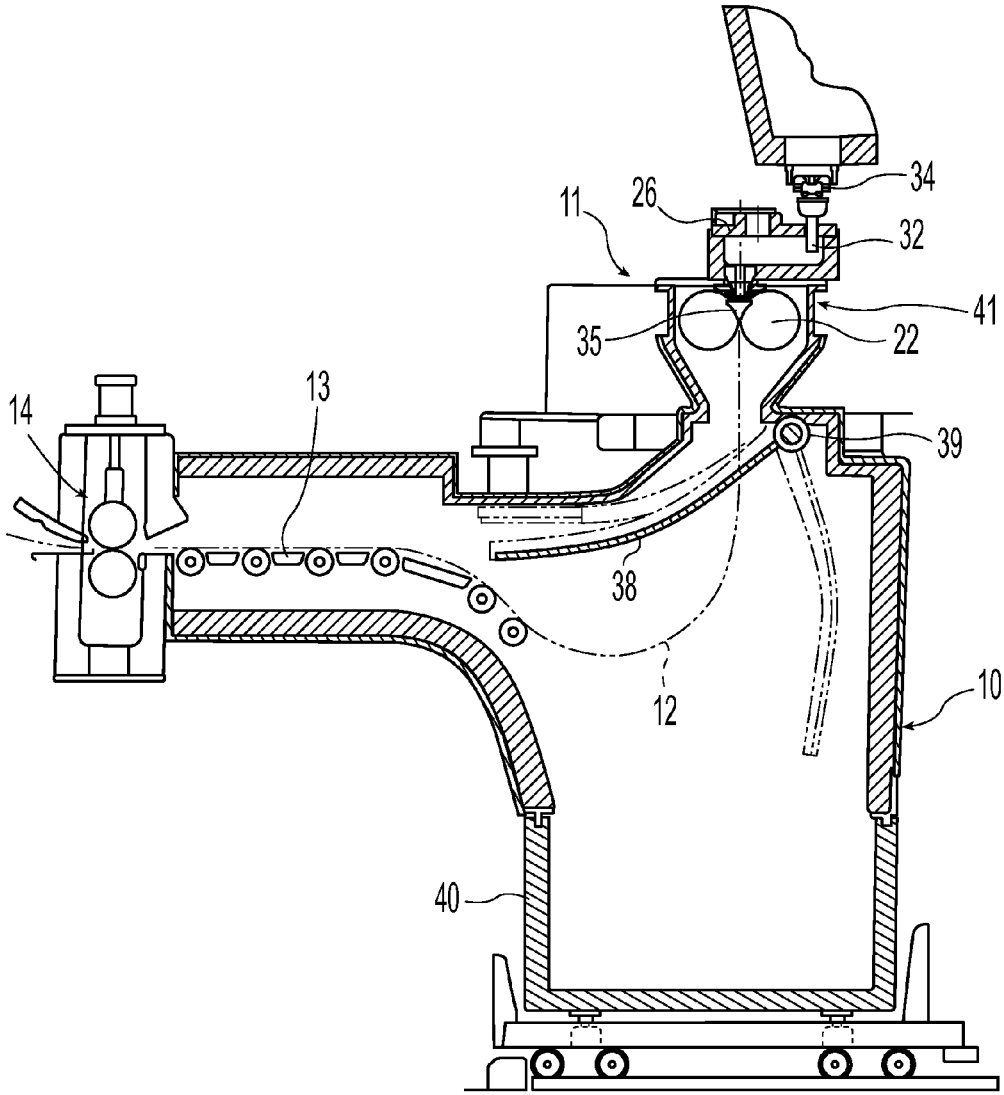
Figure 1E:
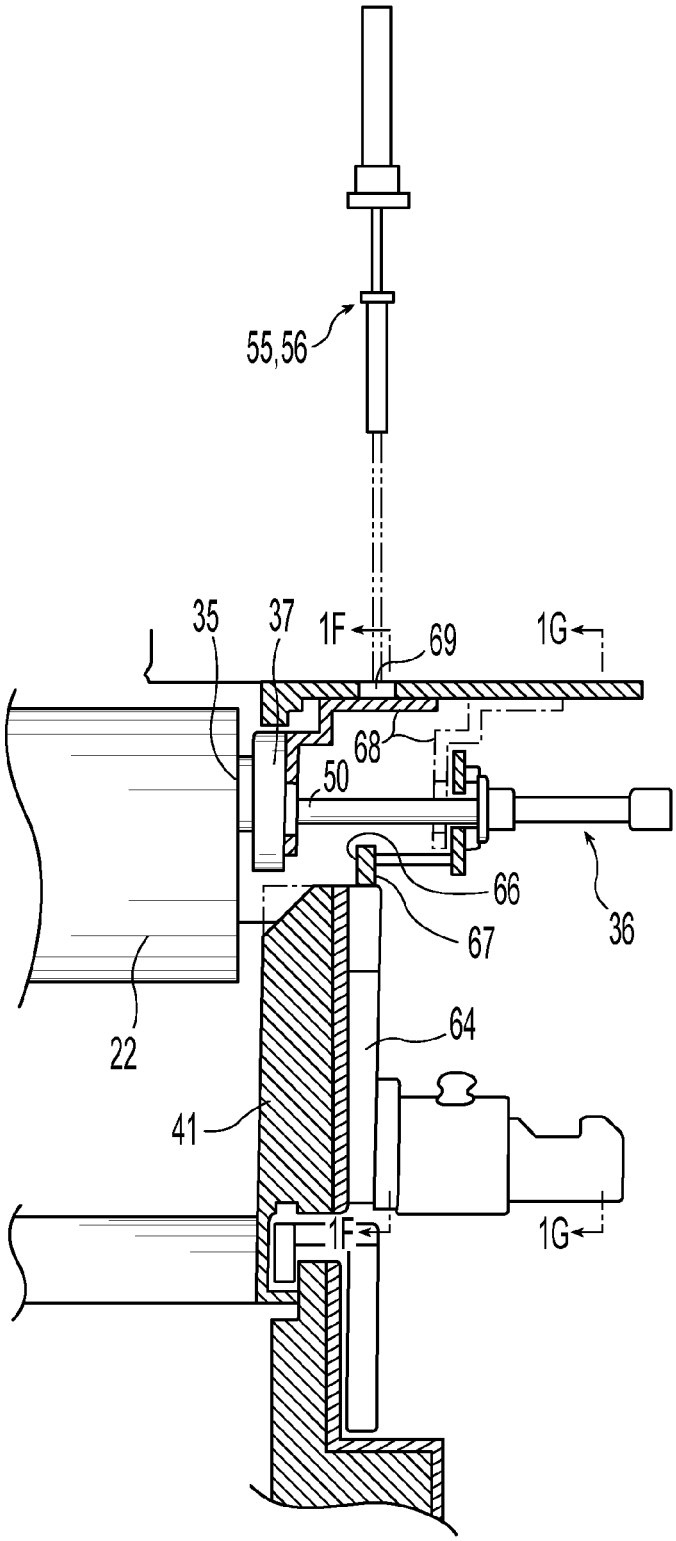
Figure 1F:
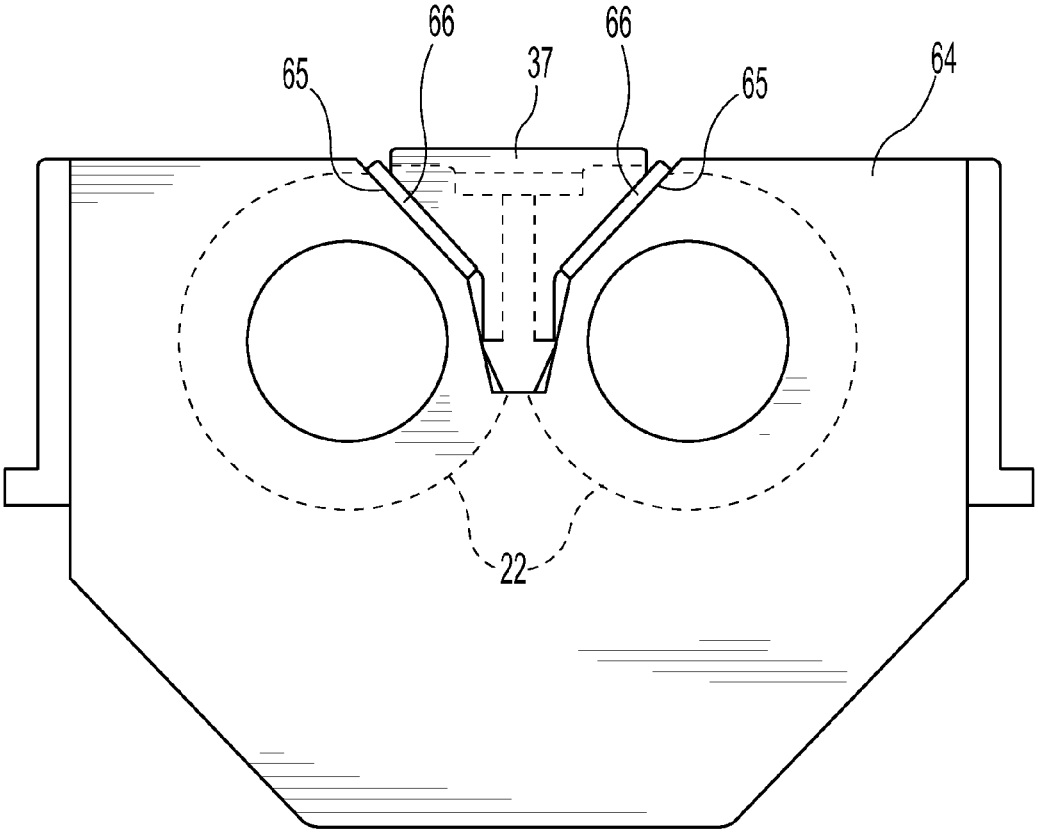
Figure 1G:
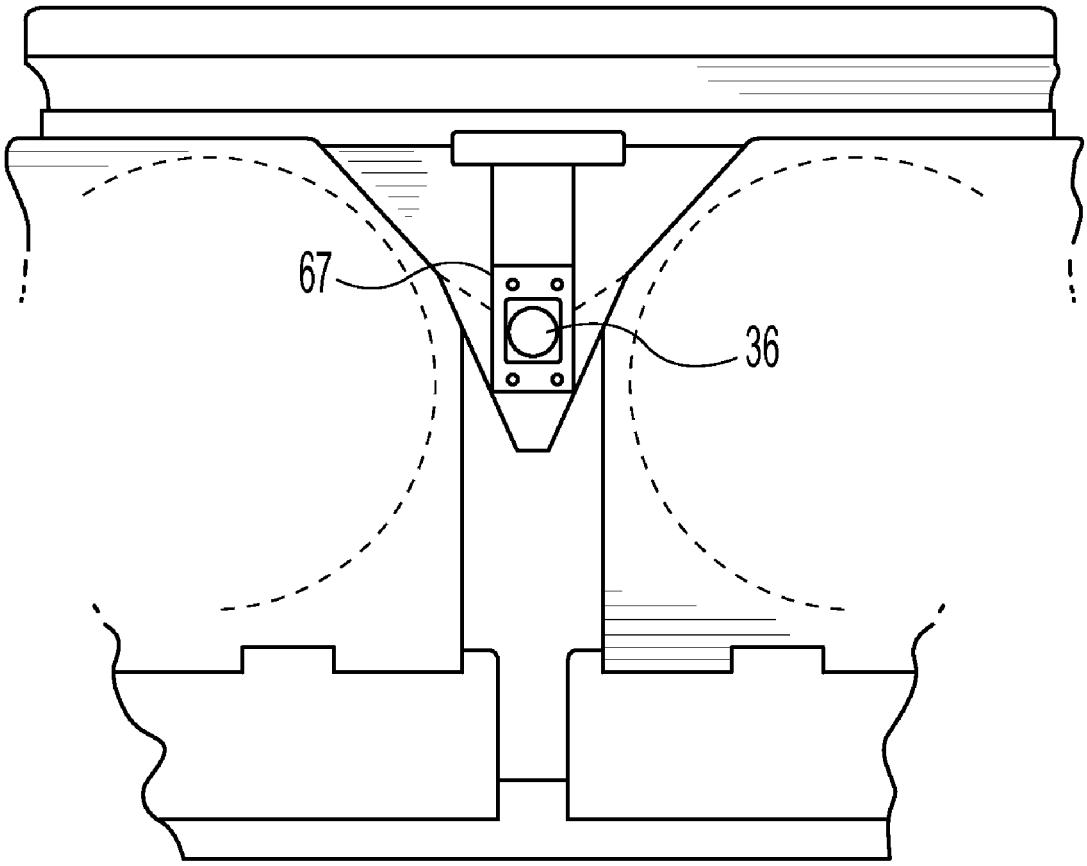

Tundish 25 is fitted with a lid 28. Molten steel is introduced into the tundish 25 from ladle 23 via an outlet nozzle 29. The tundish 25 is fitted with a stopper rod 33 and a slide gate valve 34 to selectively open and close the outlet 31 and effectively control the flow of metal from the tundish to the removable tundish 26. The molten metal flows from tundish 25 through an outlet 31 through an outlet nozzle 32 to removable tundish 26, (also called the distributor vessel or transition piece), and then to core nozzles 27. At the start of a casting operation a short length of imperfect strip is produced as the casting conditions stabilize. After continuous casting is established, the casting rolls are moved apart slightly and then brought together again to cause this leading end of the strip to break away so as to form a clean head end of the following cast strip to start the casting campaign. The imperfect material drops into a scrap box receptacle 40 located beneath caster 11 and forming part of the enclosure 10 as described below. At this time, swinging apron 38, which normally hangs downwardly from a pivot 39 to one side in enclosure 10, is swung across the strip outlet from the nip 15 to guide the head end of the cast strip onto guide table 13, which feeds the strip to the pinch roll stand 14. Apron 38 is then retracted back to its hanging position to allow the strip to hang in a loop beneath the caster, as shown in FIGS. 1B and 1D, before the strip passes to the guide table where it engages a succession of guide rollers.

The twin roll caster may be of the kind which is illustrated in some detail in U.S. Pat. Nos. 5,184,668 and 5,277,243, and reference may be made to those patents for appropriate constructional details.

The first enclosure wall section 41 surrounds the casting rolls 22 and is formed with side plates 64 provided with notches 65 shaped to snugly receive the side dam plate holders 37 when the pair of side dams 35 are pressed against the ends of casting rolls 22 by the cylinder units 36. The interfaces between the side dam holders 37 and the enclosure side wall sections 41 are sealed by sliding seals 66 to maintain sealing of the enclosure 10. Seals 66 may be formed of ceramic fiber rope or other suitable sealing material.

The cylinder units 36 extend outwardly through the enclosure wall section 41, and at these locations the enclosure is sealed by sealing plates 67 fitted to the cylinder units so as to engage with the enclosure wall section 41 when the cylinder units are actuated to press the pool closure plates against the ends of the casting rolls. Cylinder units 36 also move refractory slides 68 which are moved by the actuation of the cylinder units to close slots 69 in the top of the enclosure, through which the side dams 35 are initially inserted into the enclosure 10 and into the holders 37 for application to the casting rolls. The top of the sealed enclosure 10 is closed by the tundish 26, the side dam holders 37 and the slides 68 when the cylinder units are actuated to urge the side dams 35 against the casting rolls 22.

When it is determined that a change has to be made in the side dams 35, core nozzle 27 or removable tundish 26 due to wear or any another reason, preheating is commenced of a second refractory component identified to be in need of replacement. This preheating of the second tundish 26' or second core nozzle 27' is started while casting is continuing at least 2 hours before transfer to the operating position, and the preheating of the second side dams 35' is started at least 0.5 hours before transfer to the operating position. This preheating is done in a preheating heater 50, 54 or 57, typically a preheating chamber, in a location convenient to the caster 11, but removed from the operating position of the refractory components during casting.

During this preheating of the replacement refractory component, casting typically continues without interruption. When the refractory component to be replaced, namely, the tundish 26, the core nozzle 27 or the side dams 35, the slide gate 34 is closed and the tundish 26, the core nozzle 27 and the casting pool 16 are drained of molten metal. Typically, the tundish 26' and side dams 35' are preheated and replaced as individual refractory components, and the core nozzle is preheated and replaced as a singular or two piece refractory component, but in particular embodiments may be preheated and replaced in pieces or parts as those portions of the refractory component are worn.

When it is determined that a change has to be made in the side dams 35 due to wear or any another reason, preheating is begun of one or more second side dams 35' identified to be in need of replacement as casting continues. This preheating of the second side dams 35' is started at least 0.5 hours before transfer to the operating position. During this preheating of the replacement refractory component, casting is typically continued without interruption. When the preheating is completed and the change in side dams is to take place, the slide gate 34 is closed and the tundish 26, core nozzle 27 and casting pool 16 are drained and the casting is interrupted. A pair of transfer robots 55 remove the first side dams 35 from the operating position, and then a pair of transfer robots 56 transfer the second side dams 35' from the preheating chamber 57 to the operating position. Note that transfer robots 55 and 56 may be the same as shown in FIG. 1A if there is a place for the transfer robots to rapidly set aside the removed first side dams 35. However, to save time in removing the side dams 35 and positioning the second side dams 35' in the operating position, two pairs of transfer robots 55 and 56 may be employed. Following positioning of the second side dams 35' in the operating position, the slide gate 34 is opened to fill the tundish 26 and core nozzle 27 and form casting pool 16, and continue casting. Note that transfer robots 56 and 56 may be the same transfer robots 52 and 53, used to transfer the core nozzles, fitted with a second set of gripper arms 70.

Each transfer robot 52, 53, 55 and 56 is a robot device known to those skilled in the art with gripping arms 70 to grip the core nozzle 27 or 27' typically in two parts, or side dams 35 or 35'. They can be raised and lowered and also moved horizontally along overhead tracks to move the core nozzle 27' or the side dams 35 from a preheating chamber 54 or 57 at a separate location from the operating position to the caster for downward insertion of the plates through the slots 69 into the holders 37. Gripper arms 70 are also operable to remove at least portions of worn core nozzle 27 or side dams 35. The step of removing the worn side dam 35 is done by operating cylinder unit 36 to withdraw the thrust rod 50 sufficiently to open the slot 69 and to bring side dam 35 into position directly beneath that slot, after which the gripping arm 70 of the transfer robot 55 can be lowered through the slot to grip the side dam 35 and then raised to withdraw the worn side dam. The side dams 35 may be removed when they become worn to specified limits as will be explained further below, and may be removed one at a time as worn to a specified limit. During a casting run and at a time interval before the side dams 35 have worn down to an unserviceable level, the wear rate of the side dams 35 may be monitored by sensors, and the preheating of replacement side dams 35' is commenced in preheat furnaces at preheating chamber 57 separate from the caster 11.

To change the side dams 35, when the molten steel has drained from the metal delivery system and casting pool, cylinder units 36 are operated to retract the side dam holders 37 and to bring the side dams 35 directly beneath the slots 69 which are opened by the retraction movement of the slides 68. Transfer robots 55 may then be lowered such that their gripping arms 70 can grip the side dams 35 and raised and remove those worn side dams, which can then be dumped for scrap or refurbishment. The transfer robots 56 are then moved to the preheat chambers where they pick up the replacement side dams 35' and move them into position above the slots 69 and the retracted side dam holders 37. Side dams 35' are then lowered by the transfer robots 56 into the plate holders, the transfer robots 56 are raised and the cylinder units 36 operated to urge the preheated replacement side dams 35' against the end of the casting rolls 22 and to move the slides 68 to close the enclosure slots 69. The operator then actuates slide gate 34 to initiate resumption of casting by pouring molten steel into tundish 26 and core nozzle 27, to initiate a normal casting operation in a minimum of time.

It may be desirable to replace a side dam or dams 35 when worn to specified limits, such as when the dam(s) become or will become unserviceable. For example, the wear of the side dams may be monitored by means of load/displacement transducers mounted on cylinders 36. The cylinders will generally be operated so as to impose a relatively high force on the side dams 35 during an initial bedding-in period in which there will be a higher wear rate after which, the force may be reduced to a normal operating force. The output of the displacement transducers on cylinders 36 can then be analyzed by a control system, usually including a computerized circuit, to establish a progressive wear rate and to estimate a time at which the wear will reach a level at which the side plates become unserviceable. The control system is responsive to the sensors to determine the time at which preheating of replacement side dams must be initiated prior to interrupting the cast for replacement of the side dams.

Figure 2:
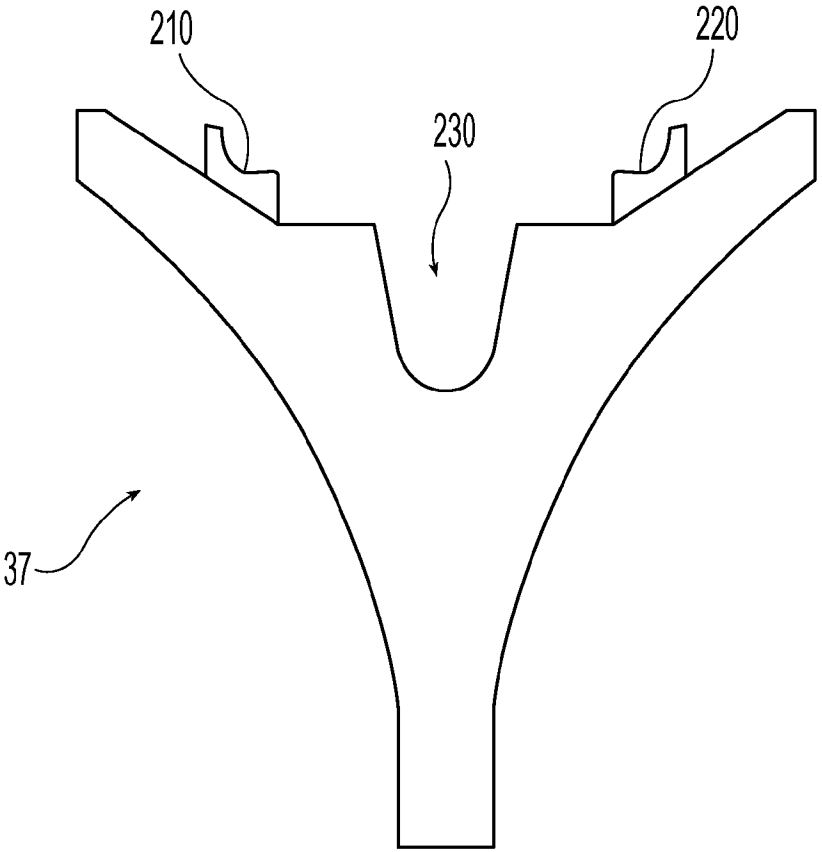
FIG. 2 illustrates an exemplary embodiment of a side dam holder, used in the system of FIGS. 1A-1G.

FIG. 2 illustrates an exemplary embodiment of a side dam holder 37 for use in the continuous casting system. The side dam holder 37 is used in the system of FIGS. 1A-1G, in accordance with several embodiments. The side dam holder 37 includes three attachment portions 210, 220, and 230. In the embodiment shown in FIG. 2, the attachment portions 210, 220, and 230 are refractory notches or troughs (typically ceramic) that are capable of receiving and supporting a side dam without exposed portions of the side dam holder 37 extending substantially beyond an outer surface of the side dam adjacent the side dam holder.

Figure 3B:
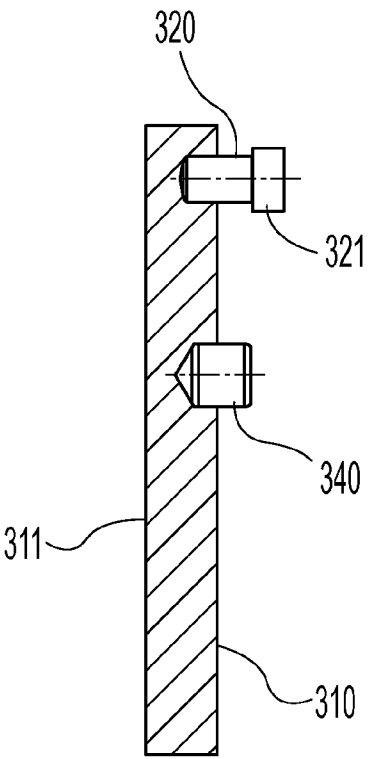
FIGS. 3A-3B illustrate an exemplary embodiment of a side dam, used in the system of FIGS. 1A-1G and held in place by the side dam holder of FIG. 2.
Figure 3A:
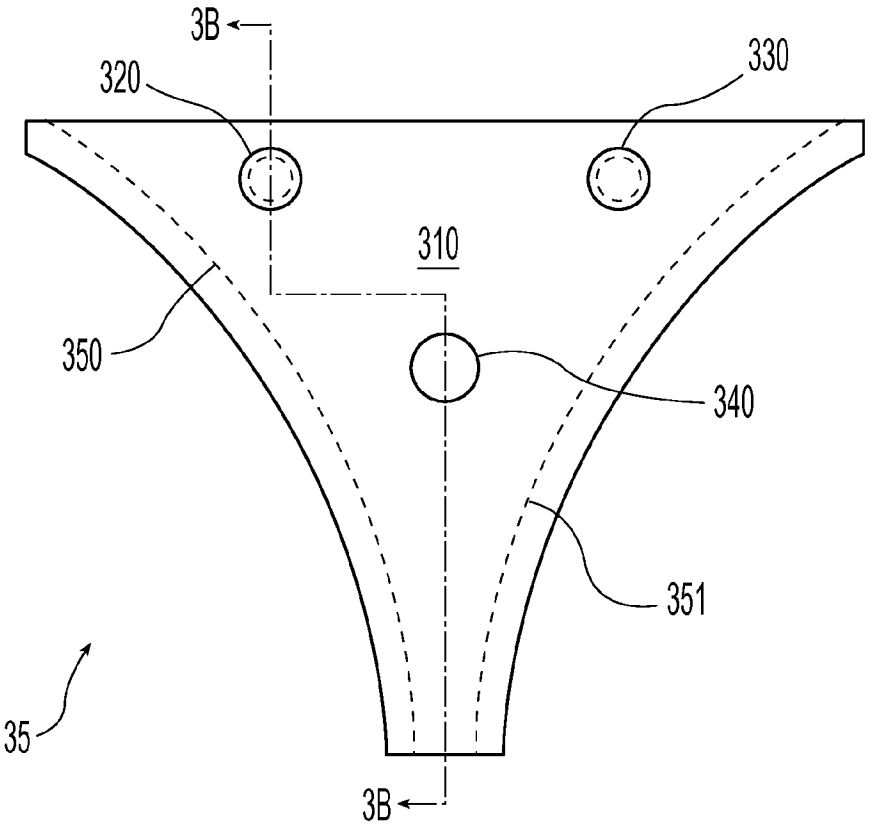

FIGS. 3A-3B illustrate an exemplary embodiment of a side dam 35, used in the system of FIGS. 1A-1G and held in place by the side dam holder 37 of FIG. 2, in accordance with several embodiments. The side dam 35 includes an outer surface 311 that faces the molten metal and an opposite outer surface 310 having three fastening portions 320, 330, and 340. FIG. 3A is a front view of the side dam 35 and FIG. 3B is a side view of the side dam 35. In accordance with an embodiment, the fastening portions 320-340 are refractory fasteners (e.g., ceramic pins) which are held in place within holes in the side dam 35 by a refractory adhesive or glue. The refractory fasteners 320-340 extend outward from the opposite outer surface 310 of the side dam 35. Graphitized alumina, boron nitride and boron nitride-zirconia composites are examples of suitable refractory materials for the side dams. The dotted lines 350 and 351 of FIG. 3A serve to illustrate where the side dam 35 makes physical contact with the casting rolls when installed in a casting machine, in accordance with an embodiment.

Alternatively, the side dam holder may have refractory attachment portions, which are usually ceramic, that extend into the fastening portions of the side dams (which are openings in the side dam), so that the exposed portions of the side dam holder do not extend substantially beyond the opposite outer side surface of the side dam toward the outer surface contacting the molten metal.

In accordance with an embodiment, the refractory fasteners 320-340 of the side dam 35 and the attachment portions 210-230 of the side dam holder 37 interact to position the side dam 35 for casting when the side dam 35 is seated onto the side dam holder 37 such that the ceramic pins 320-340 rest within the troughs 210-230. The ceramic pins 320 and 330 each include an extension (e.g., a head) 321 which serve to help hold the side dam 35 secure to the side dam holder 37 at attachment portions 210 and 220. The extensions 321 hang over the attachment portions 210 and 220 such that the side dam 35 is limited in movement with respect to the side dam holder 37 in a direction perpendicular to the opposite outer surface 310 of the side dam 35. In accordance with an embodiment, the fastening portions are refractory glued into the opposite outer surface 310 of the side dam 35.

Figure 4A:
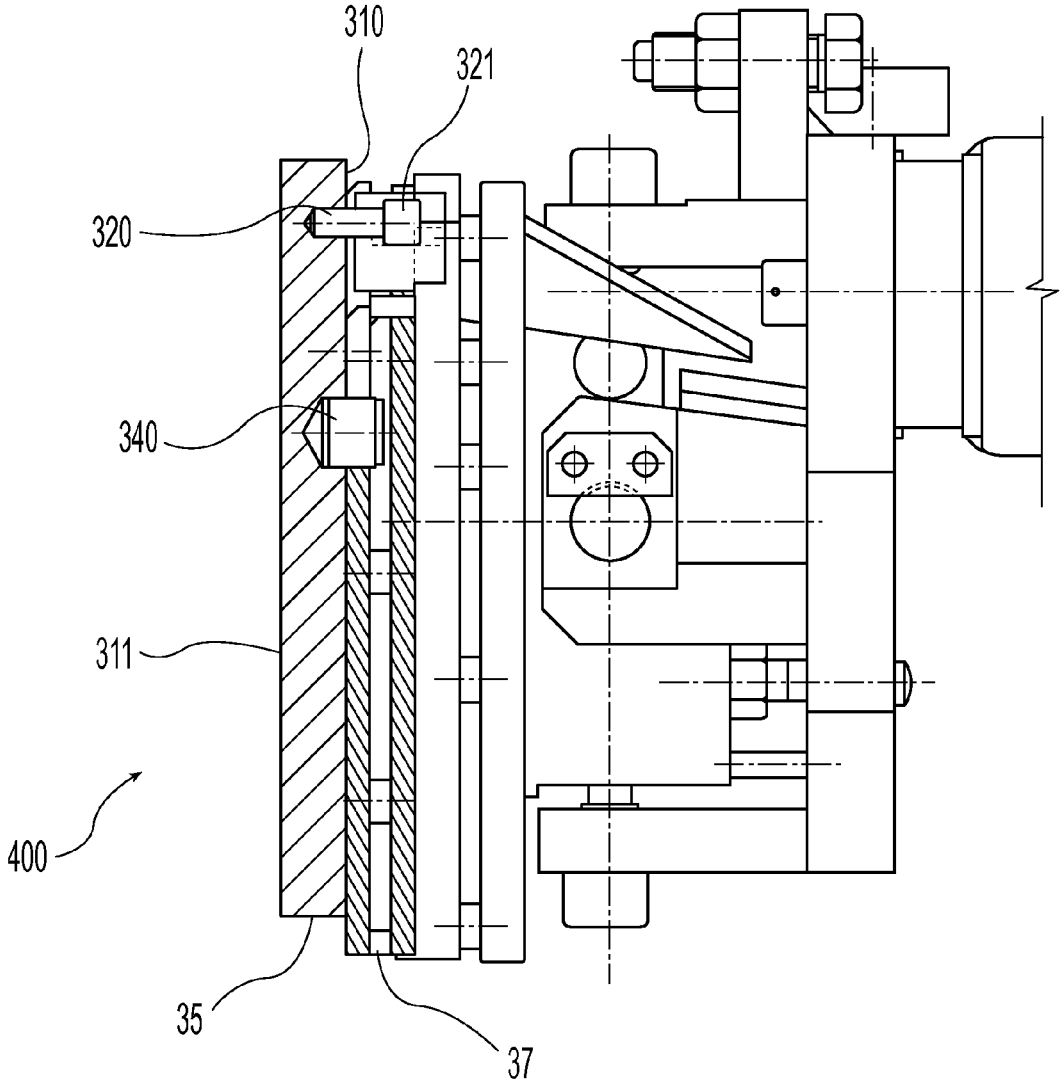
FIGS. 4A-4B illustrate an exemplary embodiment of a side dam assembly comprising the side dam holder of FIG. 2 and the side dam of FIGS. 3A-3B and used in the system of FIGS. 1A-1G.
Figure 4B:
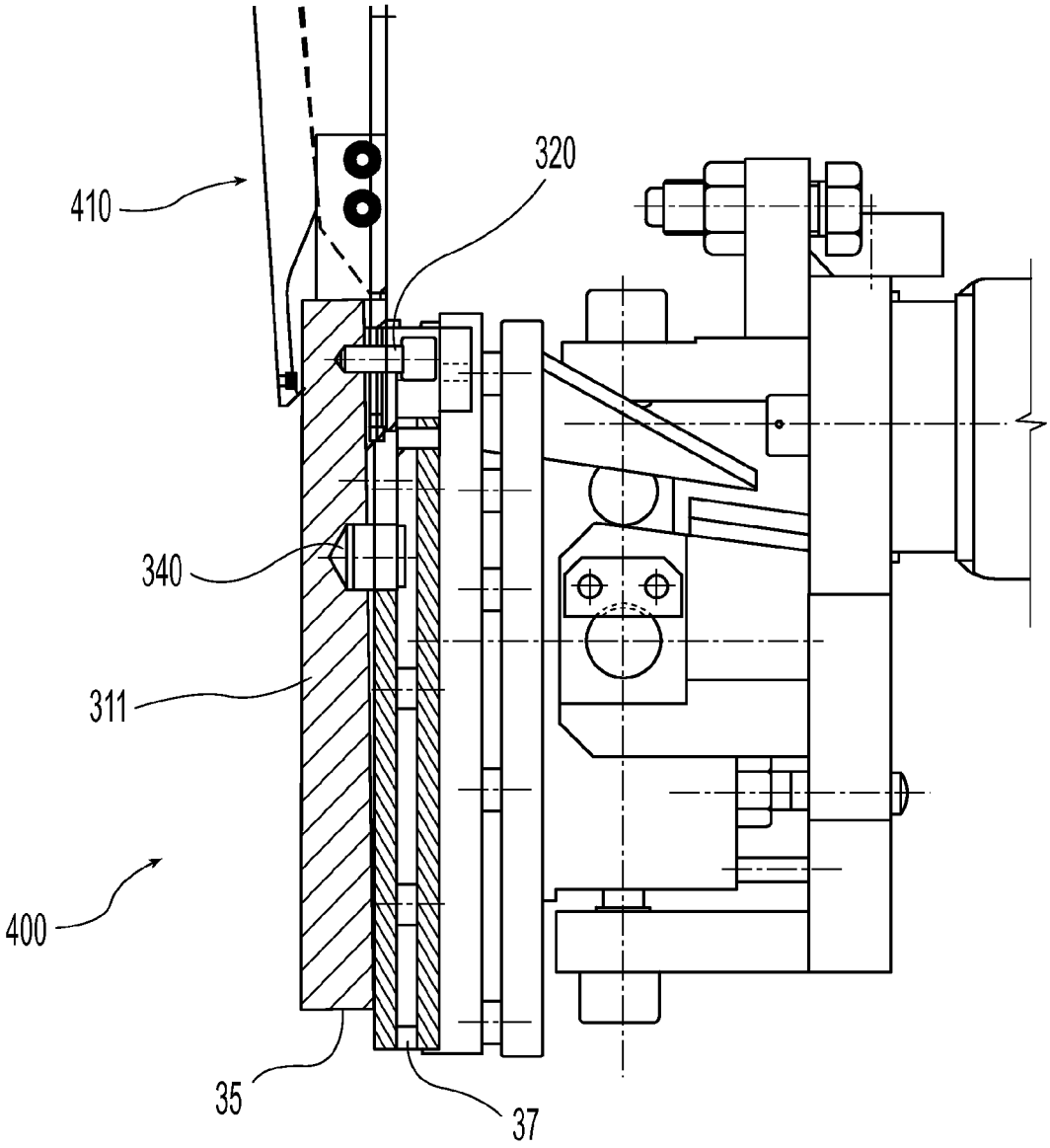

FIGS. 4A-4B illustrate an exemplary embodiment of a side dam assembly 400 comprising the side dam holder 37 of FIG. 2 seated with the side dam 35 of FIG. 3 and used in the system of FIGS. 1A-1G, in accordance with several embodiments. FIG. 4A shows the side dam assembly 400 at the cast position. FIG. 4B shows the side dam assembly 400 at installation using a transfer robot 410. The transfer robot 410 is able to extend downward, grab the side dam 35, and pull the side dam 35 upward to remove the side dam 35 from the side dam holder 37. Similarly, the transfer robot 410 is able to set a new side dam 35 down onto the side dam holder 37 as previously described herein. The transfer robot 410 does not have to be as precise in positioning the side dam 35 with respect to the side dam holder 37 as in prior art configurations. The configuration of the side dam 35 and side dam holder 37 is more forgiving with respect to positioning. Other machinery holds the side dam holder 37 in place.

In the cast position shown in FIG. 4A, the side dam 35 is positioned tightly against the side dam holder 37. No exposed portion of the side dam holder 37 extends substantially beyond the opposite outer surface 310 toward the outer surface 311 of the side dam 35 for contacting molten metal. Such a configuration allows for the side dam 35 to be used longer for casting and wear more before having to be replaced. Any or all of the fastening portions 320-340 may also be allowed to wear as the casting process proceeds, in accordance with various embodiments.

A method of producing thin cast strip by continuous casting using the system of FIGS. 1A-1G with the side dam assembly of FIGS. 4A-4B may include steps of assembling a pair of casting rolls having a nip therebetween and assembling a metal delivery system comprising side dams adjacent the ends of the nip are assembled to confine a casting pool of molten metal supported on casting surfaces of the casting rolls, where each side dam has opposed outer surfaces, one said outer surface for contacting the molten metal and the opposite outer surface having fastening portions adapted to attach the side dam to a side dam holder to hold the side dams in place during casting. The side dam holder may be configured without circumferentially exposed portions extending beyond the opposite outer surface of the side dam having the fastening portions toward the outer surface for contacting the molten metal. Then, introducing molten steel between the pair of casting rolls to form a casting pool supported on casting surfaces of the casting rolls confined by the side dams, counter-rotating the casting rolls to form solidified shells on the surfaces of the casting rolls, and casting thin steel strip through the nip between the casting rolls from the solidified shells.

Referring now to FIGS. 5 and 6, a side dam for use in a continuous twin roll caster system that has a side dam insert is disclosed. As shown, a side dam may comprise a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting. The side dam also comprises an aperture in the outer surface of the body positioned adjacent a nip of the continuous twin roll caster system and adapted to receive a side dam insert, and a side dam insert of a second refractory material harder than the body having a first surface adapted to contact molten metal and form with the outer surface of the body the outer surface of the side dam.

Figure 5B:
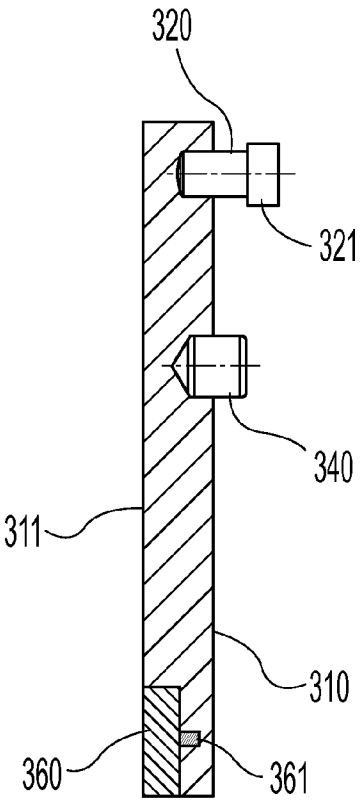
FIGS. 5A-5B illustrate an exemplary embodiment of a side dam having a side dam insert.
Figure 5A:
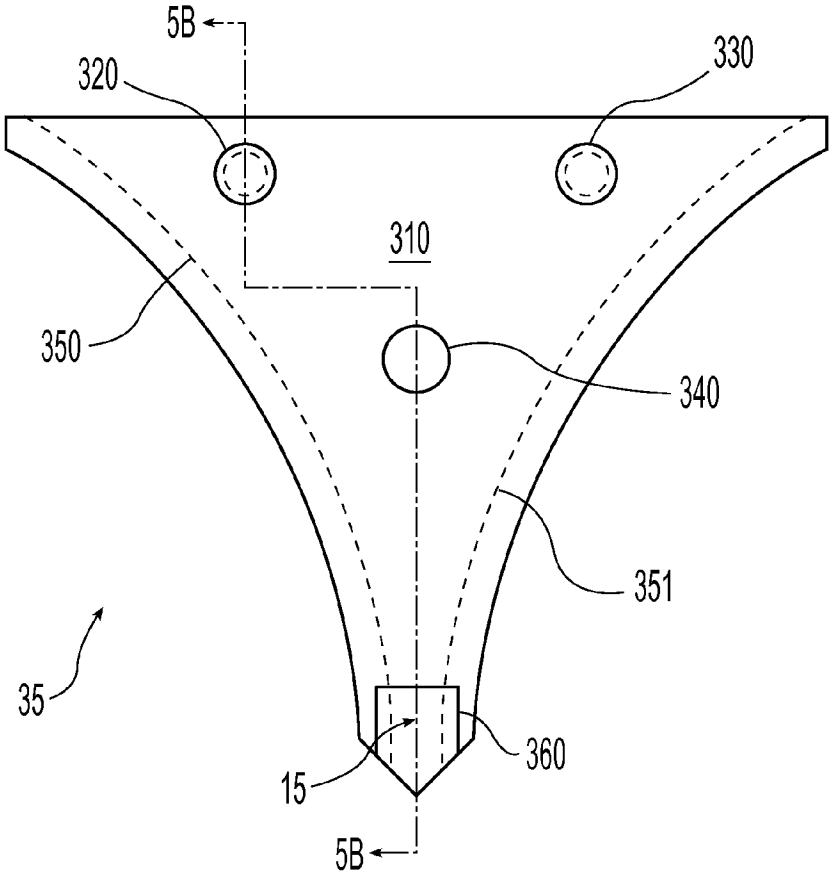

As shown in FIG. 5A, the side dam insert 360 is positioned adjacent the nip 15 near the bottom portion of the side dam 35 when assembled in a twin roll caster. During operation of the continuous twin roll caster system, metal shells solidify on the casting surfaces of the casting rolls with the side dam insert 360 contacting the solidified metal shells adjacent the nip 15. The side dam insert 360 may be formed of a second refractory material that is at least two times or at least three times harder than the refractory material of the side dam body resulting in reduced wear of the side dam adjacent the nip 15.

In one embodiment, the side dam insert 360 may have a hardness of at least 100 HB, where HB represents a Brinell hardness number. In a further embodiment, the side dam insert may have a hardness of at least 150 HB. In another embodiment, the side dam insert 360 may have a hardness of between 200 HB and 600 HB. In yet another alternatively, the side dam insert 360 may have a hardness of between 250 HB and 450 HB. By comparison, the body of refractory material of the side dam may have a hardness of approximately 85 HB. In some examples, a carbon steel may have a hardness of approximately 120 HB, whereas a stainless steel may have a hardness of approximately 200 HB. The second refractory material may thus be harder than the thin cast strip produced in the casting system. Additionally, the second refractory material may be selected depending upon the hardness of the thin cast strip expected to be produced in the casting system. The reduced wear of the side dam adjacent the nip because of the side dam insert will in turn extend the useful life of the overall side dam and increase the productivity of the twin roll casting system because fewer changes of side dam will be needed during a casting campaign.

Figure 6A:
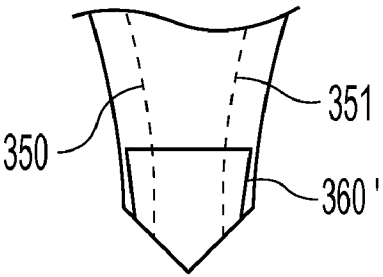
FIGS. 6A-6D illustrate other exemplary embodiments of a side dam having a side dam insert.
Figure 6B:
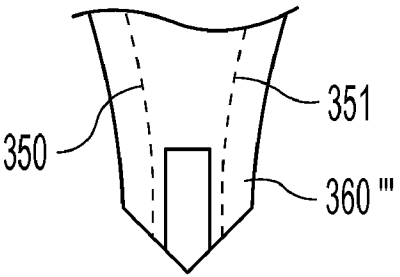
Figure 6C:
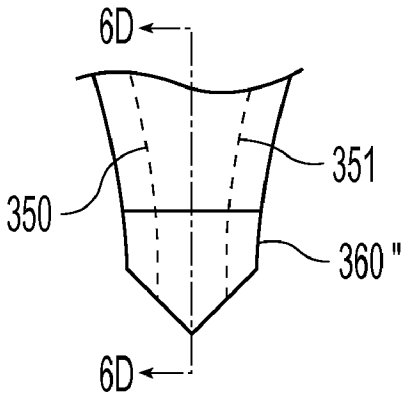
Figure 6D:
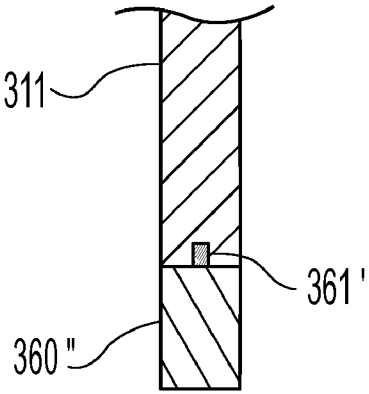

The side dam insert 360 may be of any desired length, but may extend no more than 35 mm above the nip 15 where the casting rolls are less than 0.6 meter in diameter. In another embodiment, the side dam insert 360 may extend to up to no more than 75 mm where the casting rolls are between 0.8 and 1.2 meters in diameter, or larger. For example, the side dam insert may be 30 mm in length. The side dam insert 360 may also be of any desired thickness from the outer surface of the side dam of the body toward the opposite outer surface of the side dam. The side dam insert 360 may be at least 1 mm in thickness. In some embodiments, the side dam insert 360 may be substantially the same thickness as the body between the outer surface adapted to contact molten metal and the opposite outer surface having fastening portions of refractory material, as shown in FIG. 6D discussed below. The aperture in the body adapted to receive the side dam insert 360 may thus be understood as the space occupied by the side dam insert 360.

The side dam insert 360 may extend to the bottom of the side dam 35 and may extend a distance below the nip 15. The side dam insert 360 may thus extend below the nip 15. Thin cast strip 12 may contact the side dam insert 360 as the thin cast strip is delivered downwardly from the nip also reducing wear on the side dam.

As shown in FIG. 5A, dotted lines 350, 351 illustrate where the side dam 35 makes physical contact with the casting rolls when installed in a casting machine. The side dam insert 360 may extend laterally such that the side dam insert contacts each casting roll shown by the dotted lines 350, 351. The body of refractory material may extend along each side of the side dam insert 360 as shown in FIG. 5A. In some embodiments, the aperture and the side dam insert 360' may have tapered sides adapted to retain the side dam insert in position during operation of the side dam 35, as shown in FIG. 6A. The tapered sides of the aperture and side dam insert 360' inhibit the side dam insert from moving in a generally downward direction during operation of the casting system. The tapered sides may thus resist a downward pressure applied by the casting rolls and cast strip on the side dam and side dam insert. Alternatively, the side dam insert 360" may extend across the full width of the side dam 35 as shown in FIG. 6C. In one example, the width of the side dam insert may be between 1.5 mm and 25 mm. In another example, the side dam insert may be between 5 mm and 10 mm.

In another alternative, the side dam insert may not contact the casting rolls when installed in a casting machine. For example, the side dam insert 360''' may be substantially the same as the width of the nip 15 of the continuous twin roll caster system, as shown in FIG. 6B. In this alternative, the side dam insert 360''' may also be substantially the same width as the thickness of the thin cast strip. For example, the width of the side dam insert may be approximately 1.5 mm to 2 mm.

In any event, the side dam insert 360 should have a first surface adapted to contact molten metal and contact metal shells formed on the casting surfaces of the casting rolls. The first surface of the side dam insert may also form with the outer surface of the body the outer surface of the side dam 35 adapted to contact molten metal. The first surface of the side dam insert 360 may form between 5% and 70% of the outer surface of the side dam located within 35 mm of the nip of the continuous twin roll caster. Alternatively, the first surface of the side dam insert 360 may form between 10% and 60% of the outer surface of the side dam located within 35 mm of the nip of the continuous twin roll caster. In yet another embodiment, the first surface of the side dam insert 360 may form 100% of the outer surface of the side dam 35 located within 35 mm of the nip of the continuous twin roll caster.

Additional features may be employed to retain the side dam insert in position during casting. In some embodiments, the side dam insert may have a protrusion 361 adapted to engage a notch in the aperture of the body of the side dam. As illustrated in FIG. 5B, the protrusion of the side dam insert may extend into the body of refractory material. The engagement of the protrusion 361 with the notch may secure the side dam insert 360 to the body of refractory material. The protrusion 361 and notch may also assist with alignment of the side dam insert 360 with the aperture and body of refractory material. FIG. 6D illustrates an alternate configuration of a protrusion 361' and a notch. The side dam insert 360 may be rigidly attached to the body of refractory material or may be removable. In one example, the side dam insert may be glued to the body of refractory material. It is also contemplated that the side dam insert 360 may be replaced or reused during maintenance on the side dam 35 to extend of useful life of the side dam.

As previously discussed the side dam insert 360 may be formed of a second refractory material that is harder than the refractory material of the body of the side dam 35. The second refractory material of the side dam insert may be able to withstand greater pressures applied to the side dam by the metal shells formed near the nip 15. Utilizing a harder refractory material near the nip 15 may reduce wear of the refractory material of the body and extend the useful life of an overall side dam. By lengthening the useful life of the side dam, productivity of the twin roll caster system can be substantially increased by reducing the number of side dam changes during a cast campaign.

Various materials are contemplated for use as a second refractory material. In one embodiment the second refractory material of the side dam insert may comprise boron nitride (BN) and zirconium oxide ($ZrO_2$). In another embodiment the second refractory material of the side dam insert may also comprise any one of or any combination of boron nitride (BN) and zirconium oxide ($ZrO_2$) and silicon carbide (SiC). The side dam insert of a second refractory material may thus be harder than the refractory material of the body as previously discussed.

A continuous twin roll caster system may employ the side dam insert as described above. The continuous twin roll caster system may comprise a pair of counter-rotatable casting rolls to form a nip there between through which thin strip can be cast, and a pair of confining side dams adjacent the ends of the casting rolls capable of supporting a casting pool of molten metal formed on the casting surfaces above the nip. Each side dam may comprise a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting; an aperture in the outer surface of the body positioned adjacent a nip of the continuous twin roll caster system and adapted to receive a side dam insert; and a side dam insert of a second refractory material harder than the refractory material of the body having a first surface adapted to contact molten metal and form with the outer surface of the body the outer surface of the side dam. The caster system may also comprise an elongated metal delivery system capable of discharging molten metal to form the casting pool supported on the casting surfaces of the casting rolls confined by the side dams.

Over a casting campaign the side dams 35 experience wear. With the presently described side dam insert, the wear of the side dams may be reduced. During operation of the casting machine, the side dams 35 wear at their margins which engage the end faces of the casting rolls. The inner parts of the side dams between these margins generally wear at a substantially lower rate. As previously discussed however, near the nip the inner parts of the side dam experience greater wear forming a groove. The side dam presently disclosed comprising a side dam insert may experience less wear in the region adjacent the nip reducing or eliminating the formation of the groove previously observed. Consequently, the side dam may be applied to the casting rolls with less force resulting in less wear at the margins of the side dam and further extending the useful life of the side dam and extending a casting campaign.

In accordance with an embodiment, the wear of at least portions of the side dams is monitored. The monitoring is performed by a sensor such as, for example, an optical sensor or an electrical sensor. At least a portion of a side dam is replaced when the sensor reveals that the side dam is worn to specified limits.

In summary, certain embodiments of a continuous twin roll caster system are provide having a pair of side dams where each side dam has an outer surface toward the molten metal and an opposite outer surface having fastening portions extending outward from the opposite outer surface and capable of attaching the side dam to a side dam holder at the opposite outer surface, to hold the side dam in place during casting. Each side dam includes an aperture in the outer surface of the body positioned adjacent a nip of the continuous twin roll caster system and adapted to receive a side dam insert of a second refractory material harder than the refractory material of the body having a first surface adapted to contact molten metal and form with the outer surface of the body the outer surface of the side dam.

While certain embodiments have been described, it must be understood that various changes may be made and equivalents may be substituted without departing from the sprit or scope. In addition, many modifications may be made to adapt a particular situation or material to the teachings of the disclosure without departing from its spirit or scope.

What is claimed is:

1. A side dam for use in a continuous twin roll caster system comprising:

a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting;

an aperture in the outer surface of the body positioned adjacent a nip of the continuous twin roll caster system and adapted to receive a side dam insert; and a side dam insert of a second refractory material harder than the refractory material of the body having a first surface adapted to contact molten metal and form with the outer surface of the body the outer surface of the side dam.

2. The side dam for use in a continuous twin roll caster system of claim 1, where fastening portions of the refractory material of the body extend outward from the opposite outer surface adapted to attach said side dam to a side dam holder to hold said side dam in place during casting.

3. The side dam for use in a continuous twin roll caster system of claim 1, where the aperture of the side dam further comprises a notch and the side dam insert further comprises a protrusion adapted to engage the notch of the aperture and secure the side dam insert to the side dam.

4. The side dam for use in a continuous twin roll caster system of claim 1, where the aperture and the side dam insert have tapered sides adapted to retain the side dam insert during operation of the side dam in a continuous twin roll caster system.

5. The side dam for use in a continuous twin roll caster system of claim 1, where the side dam insert extends no more than 75 mm above the nip of the continuous twin roll caster system.

6. The side dam for use in a continuous twin roll caster system of claim 1, where the side dam insert extends no more than 35 mm above the nip of the continuous twin roll caster system.

7. The side dam for use in a continuous twin roll caster system of claim 1, where the side dam insert is 30 mm in length.

8. The side dam for use in a continuous twin roll caster system of claim 1, where the width of the side dam insert is substantially the same as the width of the nip of the continuous twin roll caster system.

9. The side dam for use in a continuous twin roll caster system of claim 1, where the width of the side dam insert is between 1.5 mm and 25 mm.

10. The side dam for use in a continuous twin roll caster system of claim 1, where the width of the side dam insert is between 5 mm and 10 mm.

11. The side dam for use in a continuous twin roll caster system of claim 1, where the side dam insert extends the full width of the side dam adjacent the nip of the continuous twin roll caster system.

12. The side dam for use in a continuous twin roll caster system of claim 1, where the side dam insert is at least 1 mm thick.

13. The side dam for use in a continuous twin roll caster system of claim 1, where the side dam insert extends substantially from the outer surface adapted to contact molten metal to the opposite outer surface having fastening portions of refractory material.

14. The side dam for use in a continuous twin roll caster system of claim 1, where the side dam insert has substantially the same thickness as the body of refractory material.

15. The side dam for use in a continuous twin roll caster system of claim 1, where the first surface of the side dam insert forms between 5% and 70% of the outer surface of the side dam located within 35 mm of the nip of the continuous twin roll caster system.

16. The side dam for use in a continuous twin roll caster system of claim 1, where the first surface of the side dam insert forms between 10% and 60% of the outer surface of the side dam located within 75 mm of the nip of the continuous twin roll caster system.

17. The side dam for use in a continuous twin roll caster system of claim 1, where the second refractory material has a hardness of greater than 100 HB.

18. The side dam for use in a continuous twin roll caster system of claim 1, where the second refractory material has a hardness of greater than 150 HB.

19. The side dam for use in a continuous twin roll caster system of claim 1, where the second refractory material has a hardness between 200 HB and 600 HB.

20. The side dam for use in a continuous twin roll caster system of claim 1, where the second refractory material has a hardness between 250 HB and 400 HB.

21. The side dam for use in a continuous twin roll caster system of claim 1, where the second refractory material is at least two times harder than the body of refractory material.

22. The side dam for use in a continuous twin roll caster system of claim 1, where the second refractory material is at least three times harder than the body of refractory material.

23. The side dam for use in a continuous twin roll caster system of claim 1, where the side dam insert of a second refractory material comprises boron nitride (BN) and zirconium oxide ($ZrO_2$).

24. The side dam for use in a continuous twin roll caster system of claim 1, where the side dam insert of a second refractory material comprises boron nitride (BN) and zirconium oxide ($ZrO_2$) and silicon carbide (SiC).

25. A continuous twin roll caster system comprising:

(a) a pair of counter-rotatable casting rolls to form a nip therebetween through which thin strip can be cast, and a pair of confining side dams adjacent the ends of the casting roll capable of supporting a casting pool of molten metal formed on the casting surfaces above the nip, (b) each side dam comprising:

(i) a body of refractory material having opposed outer surfaces with one outer surface adapted to contact molten metal and casting rolls in a continuous twin roll caster system and retain molten metal, and an opposite outer surface having fastening portions of refractory material adapted to attach said side dam to a side dam holder to hold said side dam in place during casting;

(ii) an aperture in the outer surface of the body positioned adjacent a nip of the continuous twin roll caster system and adapted to receive a side dam insert; and (iii) a side dam insert of a second refractory material harder than the refractory material of the body having a first surface adapted to contact molten metal and form with the outer surface of the body the outer surface of the side dam, (c) an elongated metal delivery system capable of discharging molten metal to form the casting pool supported on the casting surfaces of the casting rolls confined by the side dams.

26. The continuous twin roll caster system of claim 25, where fastening portions of the refractory material of the body extend outward from the opposite outer surface adapted to attach said side dam to a side dam holder to hold said side dam in place during casting.

27. The continuous twin roll caster system of claim 25, where the aperture of the side dams further comprises a notch and the side dam insert further comprises a protrusion adapted to engage the notch of the aperture and secure the side dam insert to the side dam.

28. The continuous twin roll caster system of claim 25, where the aperture and the side dam insert have tapered sides adapted to retain the side dam insert during operation of the side dam in a continuous twin roll caster system.

29. The continuous twin roll caster system of claim 25, where the side dam insert extends no more than 75 mm above the nip of the continuous twin roll caster system.

30. The continuous twin roll caster system of claim 25, where the side dam insert extends no more than 35 mm above the nip of the continuous twin roll caster system.

31. The continuous twin roll caster system of claim 25, where the side dam insert is 30 mm in length.

32. The continuous twin roll caster system of claim 25, where the width of the side dam insert is substantially the same as the width of the nip of the continuous twin roll caster system.

33. The side dam for use in a continuous twin roll caster system of claim 25, where the width of the side dam insert is between 1.5 mm and 25 mm.

34. The continuous twin roll caster system of claim 25, where the width of the side dam insert is between 5 mm and 10 mm.

35. The continuous twin roll caster system of claim 25, where the side dam insert extends the full width of the side dam adjacent the nip of the continuous twin roll caster system.

36. The continuous twin roll caster system of claim 25, where the side dam insert is at least 1 mm thick.

37. The continuous twin roll caster system of claim 25, where the side dam insert extends substantially from the outer surface adapted to contact molten metal to the opposite outer surface having fastening portions of refractory material.

38. The continuous twin roll caster system of claim 25, where the side dam insert has substantially the same thickness as the body of refractory material.

39. The continuous twin roll caster system of claim 25, where the first surface of the side dam insert forms between 5% and 70% of the outer surface of the side dam located within 35 mm of the nip of the continuous twin roll caster system.

40. The continuous twin roll caster system of claim 25, where the first surface of the side dam insert forms between 10% and 60% of the outer surface of the side dam located within 75 mm of the nip of the continuous twin roll caster system.

41. The continuous twin roll caster system of claim 25, where the second refractory material has a hardness of greater than 100 HB.

42. The continuous twin roll caster system of claim 25, where the second refractory material has a hardness of greater than 150 HB.

43. The continuous twin roll caster system of claim 25, where the second refractory material has a hardness between 200 HB and 600 HB.

44. The continuous twin roll caster system of claim 25, where the second refractory material has a hardness between 250 HB and 400 HB.

45. The continuous twin roll caster system of claim 25, where the second refractory material is at least two times harder than the body of refractory material.

46. The continuous twin roll caster system of claim 25, where the second refractory material is at least three times harder than the body of refractory material.

47. The continuous twin roll caster system of claim 25, where the side dam insert of a second refractory material comprises boron nitride (BN) and zirconium oxide ($ZrO_2$).

48. The continuous twin roll caster system of claim 25, where the side dam insert of a second refractory material comprises boron nitride (BN) and zirconium oxide ($ZrO_2$) and silicon carbide (SiC).

* * * * *

UNITED STATES PATENT AND TRADEMARK OFFICE

CERTIFICATE OF CORRECTION

PATENT NO. : 8,042,601 B2
APPLICATION NO. : 12/490720
DATED : October 25, 2011
INVENTOR(S) : Brian E. Bowman, Michael A. Schueren and Walter N. Blejde It is certified that error appears in the above-identified patent and that said Letters Patent is hereby corrected as shown below:

Column 15, line 7, claim 33, "The side dame for use in a continuous" should read --The continuous--.

Signed and Sealed this
Twenty-seventh Day of December, 2011

David J. Kappos

David J. Kappos
*Director of the United States Patent and Trademark Office*